US007997222B2

(12) United States Patent
Hiroshima et al.

(10) Patent No.: US 7,997,222 B2
(45) Date of Patent: Aug. 16, 2011

(54) OUTBOARD MOTOR CONTROL SYSTEM

(75) Inventors: Naoki Hiroshima, Wako (JP); Yoshinori Masubuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 480 days.

(21) Appl. No.: 11/977,965

(22) Filed: Oct. 26, 2007

(65) Prior Publication Data

US 2008/0115712 A1 May 22, 2008

(30) Foreign Application Priority Data

Nov. 20, 2006 (JP) ..... 2006-313464

(51) Int. Cl.
*B63H 25/00* (2006.01)

(52) U.S. Cl. ..... 114/144 RE; 440/87

(58) Field of Classification Search ..... 440/84, 440/86, 87; 114/144 R, 144 E, 144 RE; 701/21
See application file for complete search history.

(56) References Cited

U.S. PATENT DOCUMENTS

| | | | | |
|---|---|---|---|---|
| 2,749,035 | A * | 6/1956 | Gray | 701/203 |
| 3,301,510 | A * | 1/1967 | Cook | 244/191 |
| 6,234,853 | B1 * | 5/2001 | Lanyi et al. | 440/53 |
| 6,994,046 | B2 * | 2/2006 | Kaji et al. | 114/144 R |
| 6,997,764 | B2 | 2/2006 | Okuyama et al. | |
| 7,220,153 | B2 | 5/2007 | Okuyama | |
| 7,402,090 | B2 * | 7/2008 | Okuyama | 440/84 |
| 7,429,202 | B2 | 9/2008 | Yazaki et al. | |
| 2005/0245145 | A1 | 11/2005 | Takada et al. | |

FOREIGN PATENT DOCUMENTS

| | | | |
|---|---|---|---|
| JP | 2000-313398 | A | 11/2000 |
| JP | 2003-127986 | | 5/2003 |
| JP | 2004-052697 | | 2/2004 |
| JP | 2005-161906 | A | 6/2005 |
| JP | 2005-319967 | | 11/2005 |
| JP | 2006-142880 | | 6/2006 |
| JP | 2006-312375 | A | 11/2006 |

* cited by examiner

*Primary Examiner* — Ed Swinehart
(74) *Attorney, Agent, or Firm* — Carrier Blackman & Associates, P.C.; Joseph P. Carrier; William D. Blackman

(57) ABSTRACT

In a system for controlling outboard motors each mounted on a boat and each having an internal combustion engine and a shift mechanism, an actuator driving at least one of the shift mechanism and a throttle valve of the engine, and a controller controlling operation of the actuator, comprising: a navigation unit having a steering wheel installed to be freely operable by an operator and a steering angle detector producing an output indicative of a steering angle of the steering wheel, wherein the outboard motors are immovably fastened to the boat, such that each of the controllers controls the operation of the actuator cooperatively based on the output of the steering angle detector, to regulate traveling direction of the boat. With this, it becomes possible to control a traveling direction of the boat based on a steering command issued by the operator, while achieving a compact outboard motor.

20 Claims, 10 Drawing Sheets

PRIOR ART

OUTBOARD MOTOR CONTROL SYSTEM

BACKGROUND OF THE INVENTION

1. Field of the Invention

This invention relates to an outboard motor control system.

2. Description of the Related Art

Conventionally, boats are commonly equipped with two or more outboard motors mounted side-by-side in what is called a "multiple outboard motor installation." In addition, in recent years, there are proposed drive-by-wire (DBW) control systems that use actuators for driving a steering mechanism, shift mechanism and throttle valve of an internal combustion engine mounted on an outboard motor, as taught by, for example, Japanese Laid-Open Patent Application No. 2005-319967. In the prior art, based on a steering command issued by the operator, the operation of the actuator connected to the steering mechanism is controlled to steer the outboard motor, thereby regulating a traveling direction of the boat.

However, when the outboard motor is configured so that the steering mechanism is connected to the actuator as described in the prior art, it adversely causes the increase of the outboard motor in size by a portion of the steering mechanism and actuator.

SUMMARY OF THE INVENTION

An object of this invention is therefore to overcome this problem by providing an outboard motor control system that can control a traveling direction of a boat based on a steering command issued by the operator, while achieving a compact outboard motor.

In order to achieve the object, this invention provides a system for controlling a plurality of outboard motors each adapted to be mounted on a stern of a boat and each having an internal combustion engine and a shift mechanism, an actuator adapted to drive at least one of the shift mechanism and a throttle valve of the engine, and a controller adapted to control operation of the actuator, comprising: a navigation unit having a steering wheel installed to be freely operable by an operator and a steering angle detector adapted to produce an output indicative of a steering angle of the steering wheel, wherein the outboard motors are immovably fastened to the boat, such that each of the controllers controls the operation of the associated actuator cooperatively based on the output of the steering angle detector, to regulate traveling direction of the boat.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An outboard motor control system according to a preferred embodiment of this invention will now be explained with reference to the attached drawings.

Figure 1:
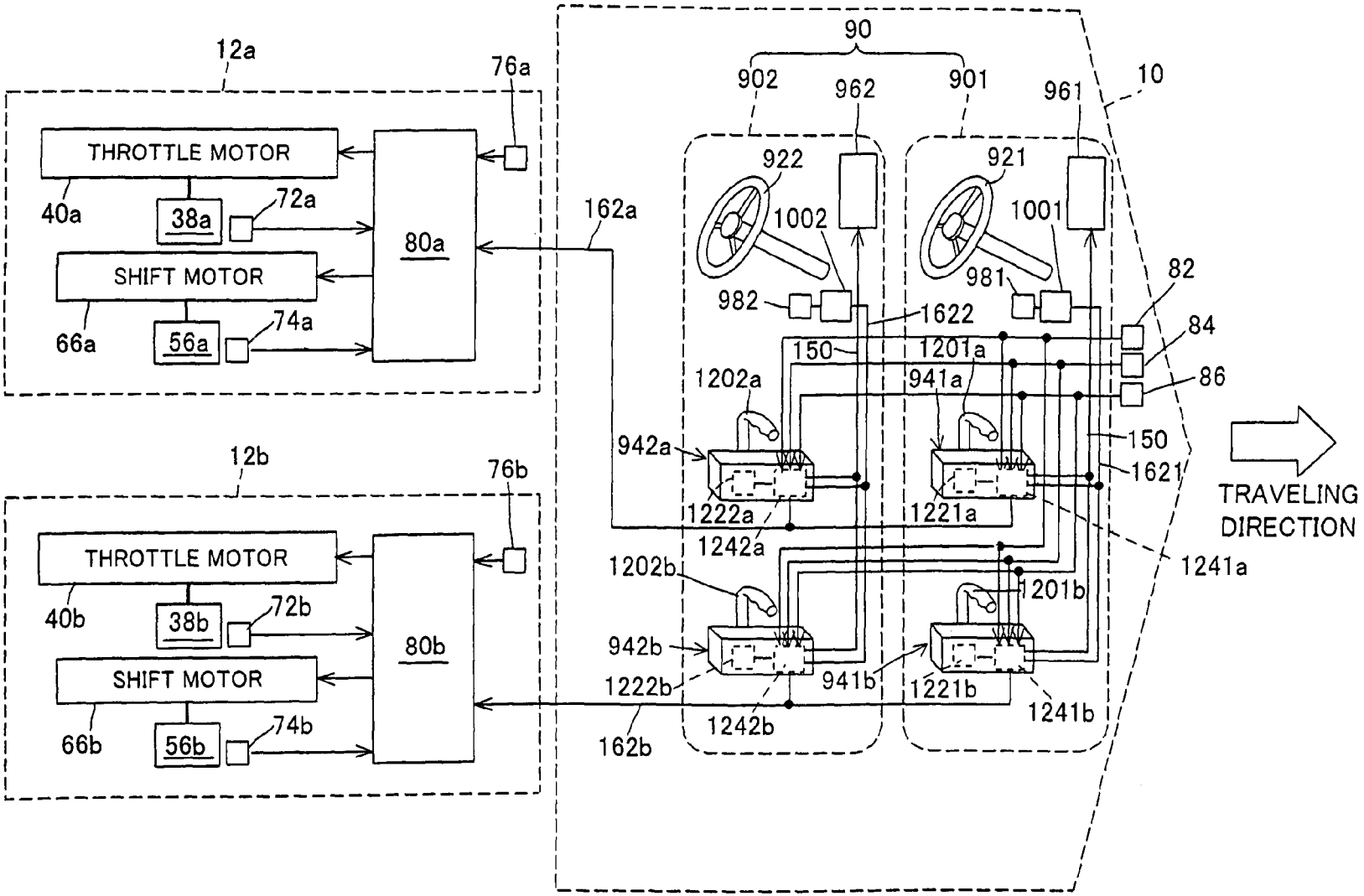
FIG. 1 is a block diagram showing an outboard motor control system according to an embodiment of this invention.

FIG. 1 is a block diagram showing an outboard motor control system according to an embodiment of this invention.

As shown in FIG. 1, a plurality of, more precisely two outboard motors 12*a, b* are mounted on the stem of a boat or hull 10. In other words, the boat 10 has what is known as a multiple or dual outboard motor installation. In the following, the port side outboard motor 12*a*, i.e., outboard motor on the left side when looking in the direction of forward travel is called the "port outboard motor", and the starboard side outboard motor 12*b*, i.e., outboard motor on the right side the "starboard outboard motor." In this specification, "left" and "right" indicate the left side and right side in the direction of forward travel.

Figure 2:
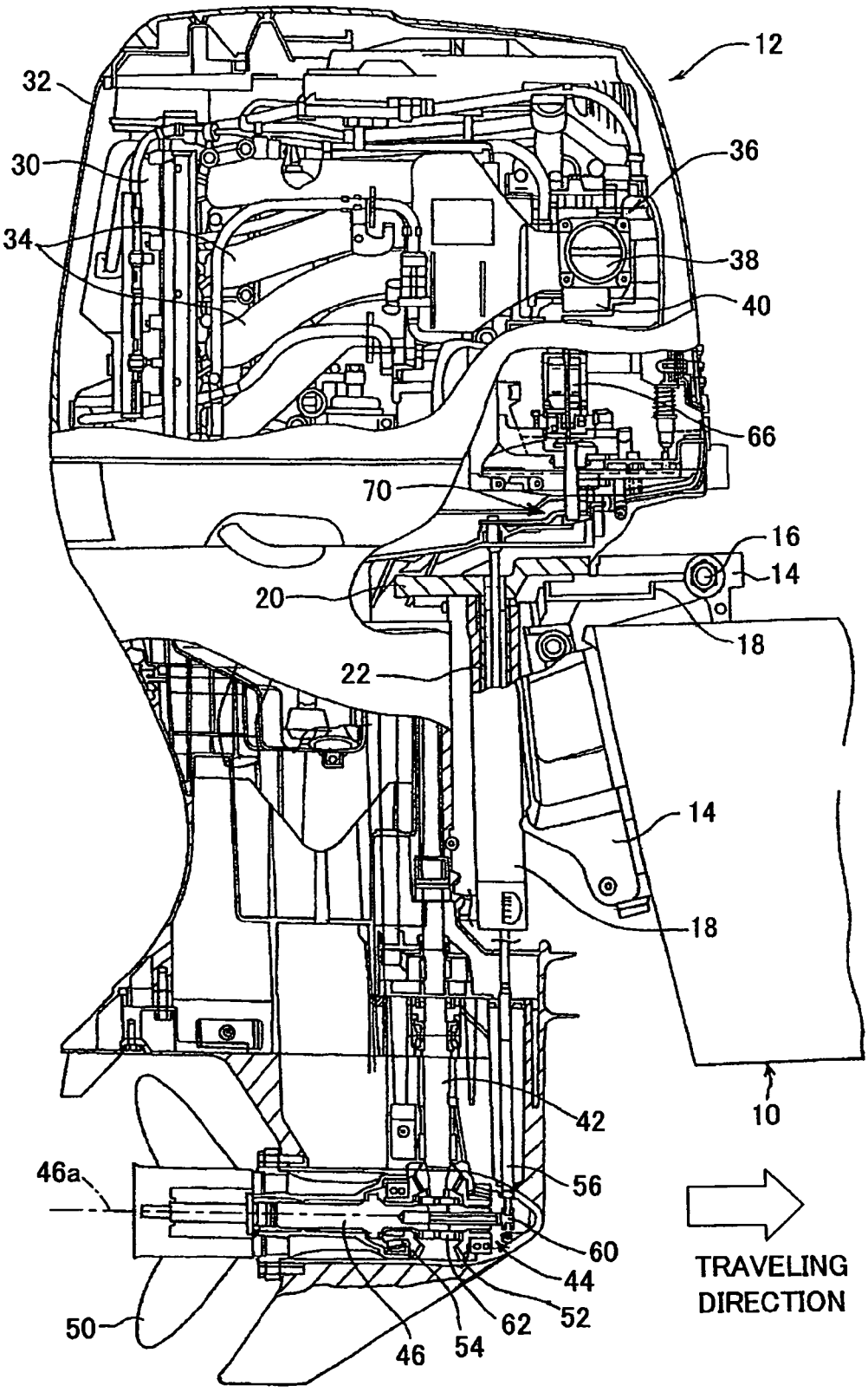
FIG. 2 is an enlarged cross-sectional side view partially showing an outboard motor shown in FIG. 1.

FIG. 2 is an enlarged cross-sectional side view partially showing the outboard motor shown in FIG. 1. Since the configurations of the port outboard motor 12*a* and starboard outboard motor 12*b* are the same, the following explanation with reference to FIG. 2 will be made without indications of a, b unless necessary to distinguish the outboard motors.

As shown in FIG. 2, the outboard motor 12 is equipped with stem brackets 14 fastened to the stem of the boat 10. A swivel case 18 is attached to the stem brackets 14 through a tilting shaft 16. A mount frame 20 installed in the outboard motor 12 is equipped with a shaft 22. The shaft 22 is fixed in the interior of the swivel case 18. The upper end of mount frame 20 and lower end thereof, i.e., lower end of the shaft 22 are fastened to a frame (not shown) constituting a main body of the outboard motor 12. Thus the outboard motor 12 is immovably fastened to the boat 10, i.e., fixed not to be rotated laterally.

The outboard motor 12 is equipped with an internal combustion engine (hereinafter referred to as "engine") 30 at its upper portion. The engine 30 comprises a spark-ignition water-cooled gasoline engine with a displacement of 2,200 cc. The engine 30 is located above the water surface and covered by an engine cover 32.

The engine 30 has an intake pipe 34 that is connected to a throttle body 36. The throttle body 36 has a throttle valve 38 installed therein and an electric throttle motor (throttle actuator) 40 is integrally disposed thereto to open and close the throttle valve 38. The output shaft of the throttle motor 40 is connected to the throttle valve 38 via a speed reduction gear mechanism (not shown) installed near the throttle body 36. Specifically, the throttle motor 40 is operated to open and close the throttle valve 38, thereby regulating air sucked in the engine 30 to control the engine speed.

The outboard motor 12 is equipped with a drive shaft 42 installed in parallel with the vertical axis and supported to be freely rotated thereabout. One end, i.e., the upper end of the drive shaft 42 is connected to a crankshaft (not shown) of the engine 30 and the other end, i.e., the lower end thereof is connected via a shift mechanism 44 with a propeller shaft 46 supported to be freely rotated about the horizontal axis. As can be seen in FIG. 2, the propeller shaft 46 is located such that its axis line 46*a* is to be substantially parallel to the traveling direction of the boat 10. One end of the propeller shaft 46 is attached with the propeller 50.

The shift mechanism 44 comprises a forward bevel gear 52 and reverse bevel gear 54 which are connected to the drive shaft 42 to be rotated, and a clutch 62 which is rotated integrally with the propeller shaft 46 and is freely engaged with either one of the forward bevel gear 52 and reverse bevel gear 54 by displacement of a shift rod 56 and shift slider 60.

The interior of the engine cover 32 is disposed with an electric shift motor (shift actuator) 66 that drives the shift mechanism 44. The output shaft of the shift motor 66 is freely connected via a speed reduction gear mechanism 70 with the upper end of the shift rod 56 of the shift mechanism 44. Therefore, when the shift motor 66 is driven, its output displaces the shift rod 56 and shift slider 60, thereby driving the clutch 62 to be engaged with either the forward bevel gear 52 or the reverse bevel gear 54.

The rotational output of the drive shaft 42 is transmitted via the shift mechanism 44 to the propeller shaft 46 to rotate the propeller 50 in one of the directions making the boat 10 move forward or rearward. The engagement of the clutch 62 with one of the bevel gears 52, 54 can be released by driving the shift motor 66 to displace the shift slider 60 to an appropriate position. Specifically, the shift motor 66 is driven to operate the clutch 62 of the shift mechanism 44, thereby switching the shift position among forward, reverse and neutral positions.

Thus the outboard motor 12 is configured such that the shift mechanism 44 and throttle valve 38 of the mounted engine 30 are operated by the motors 40, 66. The outboard motor 12 does not have a steering mechanism, electric steering motor (actuator) connected thereto and the like, which are included in a prior art outboard motor, and is immovably fastened to the boat 10. The outboard motor 12 is equipped with a power source (not shown) such as a battery or the like attached to the engine 30 to supply operating power to the motors 40, 66, a lever position sensor unit (explained later) and other components.

The explanation of FIG. 1 will be resumed. The two outboard motors 12 are each equipped with a throttle opening sensor 72 and shift position sensor 74. The throttle opening sensor 72 is installed near the throttle valve 38 and produces an output or signal indicative of throttle opening.

The shift position sensor 74 is installed near the shift rod 56 and produces an output or signal indicative of shift position, i.e., rotation angle of the shift rod 56. Each of the outboard motors 12 is further equipped with a crank angle sensor 76 installed near the crankshaft of the engine 30 to produce an output or signal indicative of engine speed of the engine 30.

The outputs of the foregoing sensors are sent to an ECU (electronic control unit) 80 mounted in each of the two outboard motors 12, as shown in FIG. 1. The ECU 80 is constituted as a microcomputer including a CPU, ROM, RAM and other devices and installed in the engine cover 32 of the outboard motor 12.

The boat 10 comprises a declinometer 82 that receives a signal, e.g., a GPS (Global Positioning System) signal to produce an output or signal indicative of a current position or direction, i.e., current traveling direction etc., of the boat 10, and sensors that produce outputs or signals indicative of traveling speed of the boat 10, specifically an angular acceleration sensor (traveling speed detector) 84 producing an output or signal indicative of angular acceleration and an acceleration sensor (accelerometer; traveling speed detector) 86 producing an output or signal indicative of acceleration. The angular acceleration sensor 84 and acceleration sensor 86 are composed of, for instance, a gyro sensor, or a sensor of capacitance-type, piezoelectric-type, gas migration-type or the like.

The boat 10 is equipped with multiple, i.e., two navigation units 90 installed to be freely manipulated by the operator. In the following, the navigation unit with reference numeral 90 having a suffix 1, namely 901, will be called the first navigation unit and the navigation unit with 90 having a suffix 2, namely 902, will be called the second navigation unit. Reference numeral 90 is assigned when the navigation units 901, 902 are collectively called.

The first and second navigation units 901, 902 produce outputs or signals indicative of drive commands for the aforementioned motors in response to manipulation by the operator. Specifically, the first navigation unit 901 comprises a steering wheel 921 disposed to be freely rotated or manipulated by the operator, a plurality of, i.e., two remote control boxes 941*a, b* and an indicator 961 that indicates the current wheel steering angle, boat speed and the like. Similarly, the second navigation unit 902 comprises a steering wheel 922, a plurality of, i.e., two remote control boxes 942*a, b* and an indicator 962.

Among the four remote control boxes, the remote control boxes 941*a*, 942*a* produce outputs or signals indicating drive commands for the port outboard motor 12*a* and the remote control boxes 941*b*, 942*b* for the starboard outboard motor 12*b*.

The steering wheels 921, 922 are used or rotated by the operator to input rudder turning commands to the outboard motors 12, i.e., input a traveling direction of the boat 10 desired by the operator. Steering angle sensors (steering sensor; steering angle detector) 981, 982 installed near the rotary shafts of the steering wheels 921, 922 produce outputs or signals the manipulated variables, namely, steering angles of the steering wheels 921, 922 manipulated by the operator.

The steering angle sensors 981, 982 are connected to steering angle sensor units (steering sensor unit; steering angle detector) 1001, 1002, respectively, that are inputted with the outputs indicative of steering angles produced by the steering angle sensors.

Figure 3:
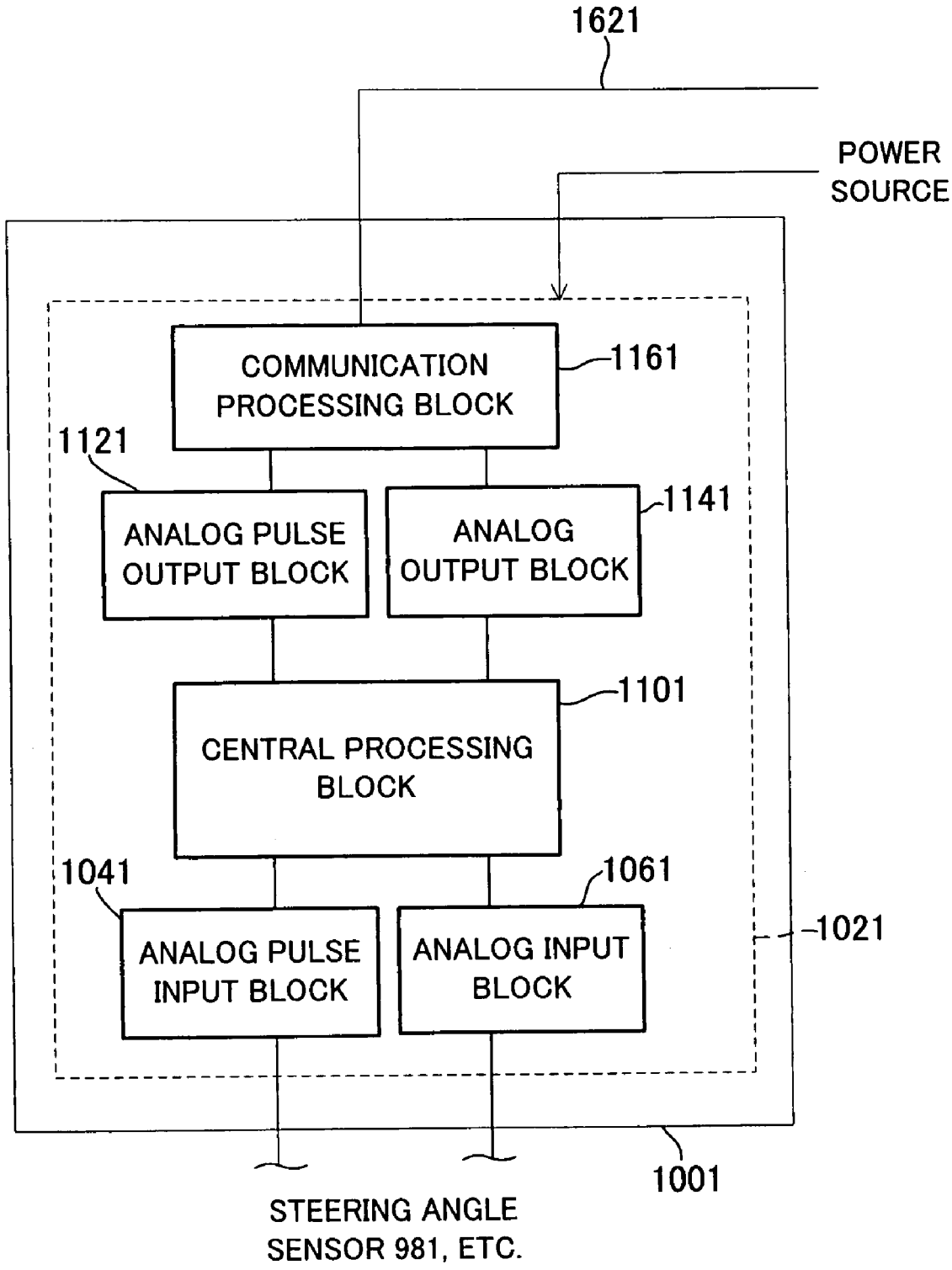
FIG. 3 is a block diagram showing the structure of a steering angle sensor unit shown in FIG. 1.

FIG. 3 is a block diagram showing the structure of the steering angle sensor unit 1001. It should be noted, although the explanation will be made with respect to the steering angle sensor unit 1001 in the following, since the configurations of the steering angle sensor units 1001, 1002 are substantially the same, the explanation below can also be applied to the steering angle sensor unit 1002.

As shown in FIG. 3, the steering angle sensor unit 1001 is equipped with a main processing section 1021 and the like. The main processing section 1021 comprises an analog pulse input block 1041 and analog input block 1061 that are connected to the steering angle sensor 981 (not shown in FIG. 3) and the like to be inputted with the detected steering angle etc., a central processing block 1101 that is connected to the analog pulse input block 1041 and analog input block 1061 and based on the steering angle, carries out appropriate calculation, an analog pulse output block 1121 and analog output block 1141 that are connected to the central processing block 1101 to output the calculated value indicative of the steering angle, and a communication processing block 1161 that is connected to the analog pulse output block 1121 and analog output block 1141 and outputs or forwards the outputted value to the lever position sensor unit (explained later) and the like. The main processing section 1021 of the steering angle sensor unit 1001 is connected to the power source of the outboard motor 12 to be supplied with operating power.

The explanation of the navigation units 901, 902 in FIG. 1 will be resumed. The remote control boxes 941*a, b*, 942*a, b* are equipped with shift/throttle levers 1201*a, b*, 1202*a, b* installed to be freely swung or manipulated by the operator. The shift/throttle levers 1201*a, b*, 1202*a, b* are used by the operator to input shift position change commands (commands for operating the shift motors 66*a, b*) and engine speed regulation commands (commands for operating the throttle motors 40*a, b*).

Lever position sensors (lever position detector) 1221*a, b*, 1222*a, b* are installed near the shift/throttle levers 1201*a, b*, 1202*a, b*. The lever position sensors 1221*a, b*, 1222*a, b* produce outputs or signals indicative of manipulated variables or manipulated positions of the shift/throttle levers 1201*a, b*, 1202*a, b* operated by the operator, i.e., lever positions.

The lever position sensors 1221*a, b*, 1222*a, b* are connected to lever position sensor units (shift/throttle sensor unit; lever position detector) 1241*a, b*, 1242*a, b* that are inputted with outputs indicative of the lever positions produced by the lever position sensors.

Figure 4:
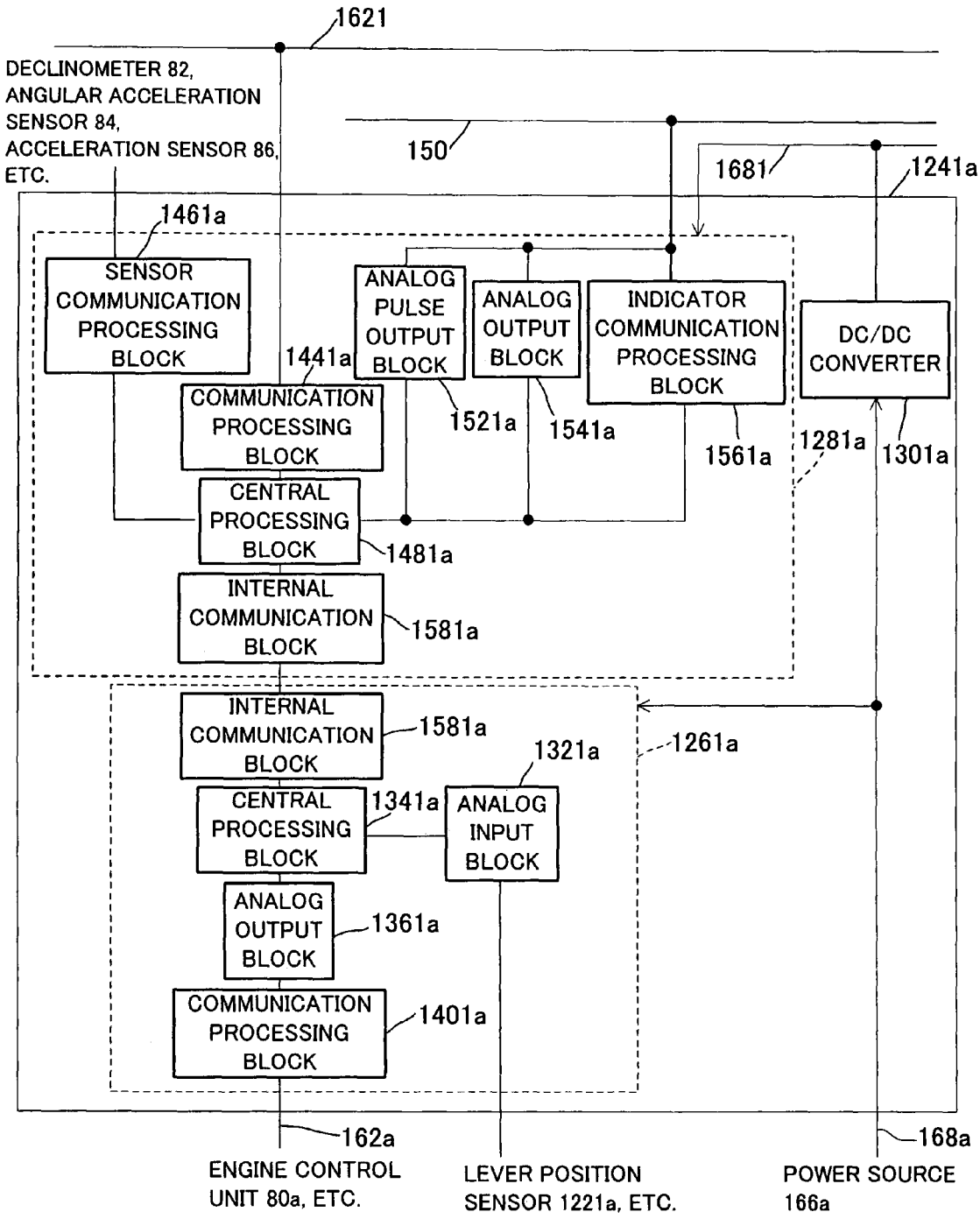
FIG. 4 is a block diagram showing the structure of a lever position sensor unit shown in FIG. 1.

FIG. 4 is a block diagram showing the structure of the lever position sensor unit 1241*a*. It should be noted, although the explanation will be made with respect to the lever position sensor unit 1241*a* in the following, since the configurations of the other lever position sensor units 1241*b*, 1242*a, b* are substantially the same, the explanation below can be applied to the lever position sensor units 1241*b*, 1242*a, b*.

As shown in FIG. 4, the lever position sensor unit 1241*a* is equipped with a main processing section 1261*a*, isolation section 1281*a*, DC/DC converter 1301*a*. The main processing section 1261*a* comprises an analog input block 1321*a* that is connected to the lever position sensor 1221*a* (not shown in FIG. 4) and the like to be inputted with the detected lever position etc., a central processing block 1341*a* that is connected to the analog input block 1321*a* and based on the lever position, carries out appropriate calculation, an analog output block 1361*a* that is connected to the central processing block 1341*a* to output the calculated value indicative of the lever position, and a communication processing block 1401*a* that is connected to the analog output block 1361*a* and outputs or forwards the outputted value to the engine control unit 80*a* and the like.

The isolation section 1281*a* comprises a communication processing block 1441*a* connected to the steering angle sensor unit 1001, precisely the communication processing block 1161 of the steering angle sensor unit 1001 (neither shown in FIG. 4) and the like, to be inputted with a value indicative of steering angle, a sensor communication processing block 1461*a* connected to the declinometer 82, angular acceleration sensor 84, acceleration sensor 86 and the like to be inputted with detected values of those sensors, a central processing block 1481*a* that is connected to the communication processing block 1441*a* and sensor communication processing block 1461*a* and based on the steering angle and detected values, carries out appropriate calculation, and an analog pulse output block 1521*a*, analog output block 1541*a* and indicator communication processing block 1561*a* that are connected to the central processing block 1481*a* and output or forward the calculated value indicative of the steering angle etc. to the indicator 961 and the like through an electric signal line 150. The main processing section 1261*a* and isolation section 1281*a* are equipped with internal communication blocks 1581*a*. Interconnection of the internal communication blocks 1581*a* enables signals to be sent to and received by each other.

Next, the connections between the steering angle sensor units 1001, 1002 and lever position sensor units 1241*a, b*, 1242*a, b* installed in the boat 10, and the engine control units 80*a, b* installed in the two outboard motors 12*a, b* will be explained.

Figure 5:
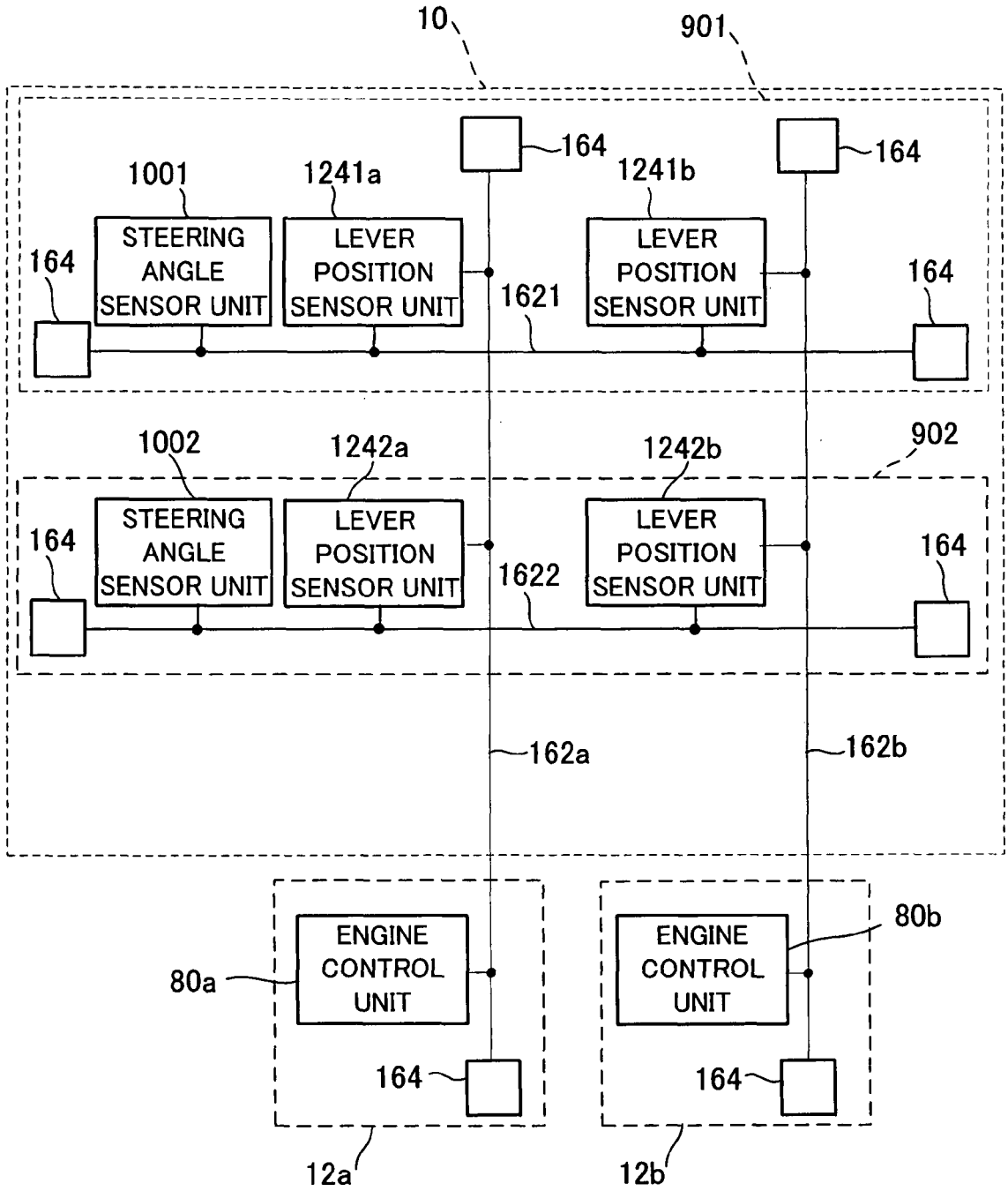
FIG. 5 is a view explaining connections between units shown in FIG. 1.

FIG. 5 is a view explaining the connections between the units. In FIG. 5, merely the units and electric signal lines connecting them are illustrated for ease of understanding.

Figure 12:
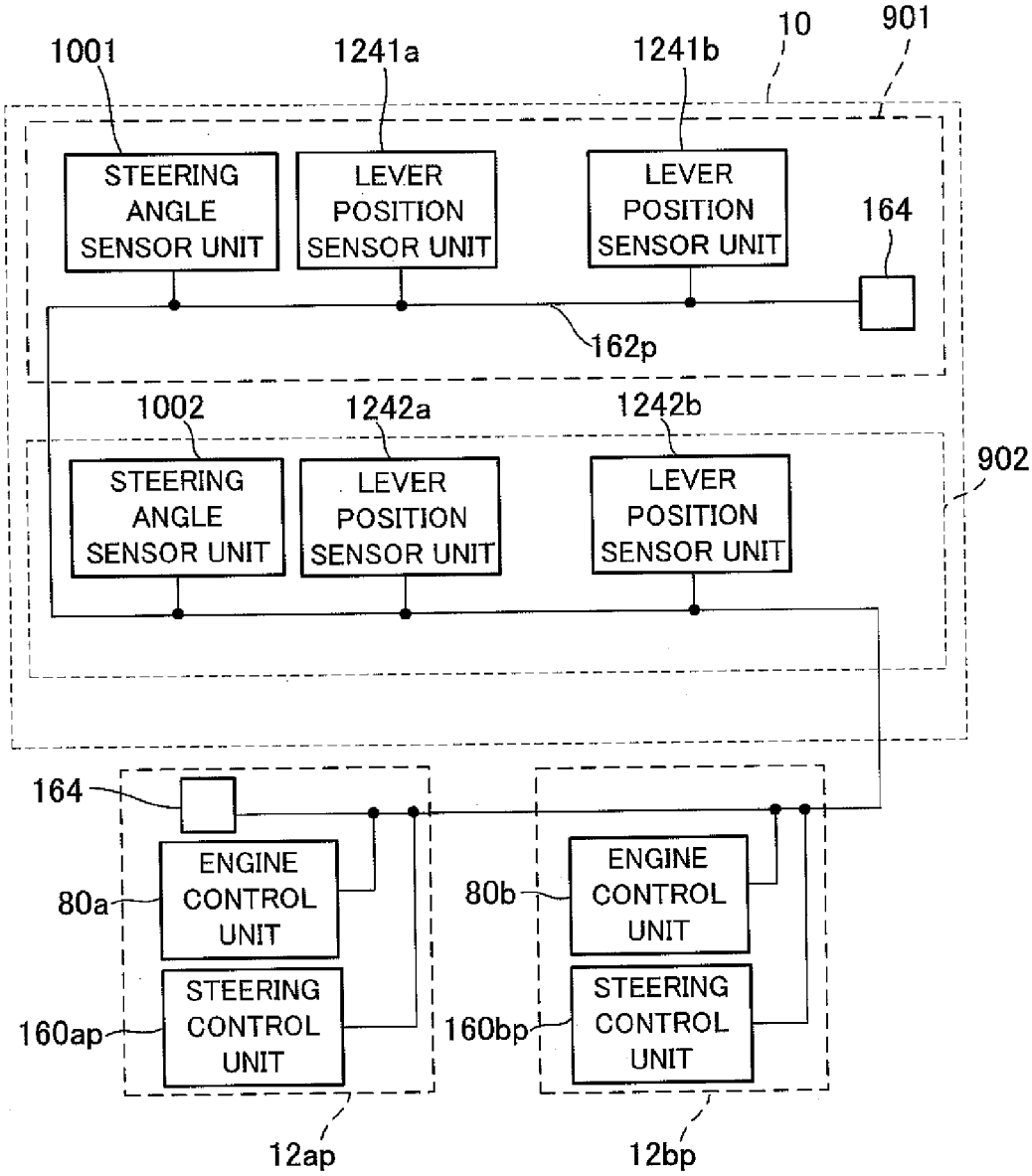
FIG. 12 is a view similar to FIG. 5 but explaining a controller of an outboard motor according to a prior art.

Before making the explanation with reference to FIG. 5, the connections between units of an outboard motor control system according to a prior art will be explained with reference to FIG. 12. In a known system for controlling an outboard motor, since it is configured such that the operation of an electric steering motor connected to a steering mechanism of the outboard motor is controlled to steer the outboard motor right and left so as to regulate traveling direction of a boat, the outboard motor is equipped with, in addition to the foregoing units, a steering control unit 160*ap* or 160*bp* that controls the operation of the steering motor.

When a plurality of, i.e., two outboard motors 12*ap*, 12*bp* are attached to a boat, the steering angle sensor units 1001, 1002 and lever position sensor units 1241*a, b*, 1242*a, b* in the boat are connected to the engine control units 80*a, b* and steering control units 160*ap, bp* in the outboard motors in series through an electric signal line (digital communication line) 162*p*. The both ends of the signal line 162*p* are connected to communication stabilizers 164 each composed of a resistor for stabilizing communication by fixing impedance in a communication circuit.

However, with this configuration in which the units are connected in series through the one electric signal line 162*p*, when the operation of the actuators, i.e., the throttle motors 40*a, b*, shift motors 66*a, b*, etc. of the outboard motors 12 is controlled for each of the outboard motors, it is necessary to identify the respective outboard motors, i.e., to rewrite software for each of the outboard motors, resulting in increase of complicated tedious work.

In this embodiment, therefore, it is configured to connect the steering angle sensor units 1001, 1002 and lever position sensor units 1241*a, b*, 1242*a, b* installed in the boat 10 to the engine control units 80*a, b* installed in the outboard motors 12*a, b* through electric signal lines (digital communication lines) separately, i.e., in parallel for the individual outboard motors.

The details will be explained in reference to FIG. 5. The steering angle sensor unit 1001 (precisely, the communication processing block 1161 (not shown in FIG. 5) of the steering angle sensor unit 1001) of the first navigation unit 901 is connected to the lever position sensor units 1241*a, b* (precisely, the communication processing blocks 1441*a, b* (not shown) of the isolation sections 1281*a, b* of the lever position sensor units 1241*a, b*) through an electric signal line (first signal line) 1621. Similarly, the steering angle sensor unit 1002 of the second navigation unit 902 is connected to the lever position sensor units 1242*a, b* through an electric signal line (first signal line) 1622.

The lever position sensor unit 1241*a* (precisely, the communication processing block 1401*a* (not shown in FIG. 5) of the main processing section 1261*a* of the lever position sensor unit 1241*a*) of the first navigation unit 901 and the lever position sensor unit 1242*a* (precisely, the communication processing block 1402*a* (not shown) of the main processing section 1262*a* of the lever position sensor unit 1242*a*) of the second navigation unit 902 are connected to the engine control unit 80*a* of the port outboard motor 12*a* through an electric signal line (second signal line) 162*a*.

Similarly, the lever position sensor unit 1241*b* of the first navigation unit 901 and the lever position sensor unit 1242*b* of the second navigation unit 902 are connected to the engine control unit 80*b* of the starboard outboard motor 12*b* through an electric signal line (second signal line) 162*b*. The electric signal lines 1621, 1622, 162*a, b* are each connected at its both ends with the communication stabilizers 164.

Thus, the outboard motor control system according to this embodiment is configured such that the lever position sensor units 1241*a, b*, 1242*a, b* installed in the boat are connected to the engine control units 80*a, b* installed in the two outboard motors 12*a, b* through the electric signal lines 162*a, b* separately, i.e., in parallel for the individual outboard motors. With this, it becomes possible to control the operation of the actuators installed in the outboard motors separately for the individual outboard motors in spite of simple structure, specifically, without work to identify the respective outboard motors.

Next, an operating power source of the outboard motor control system, specifically, a power source that supplies operating power to the lever position sensor units 1241*a, b*, 1242*a, b* will be explained.

Figure 6:
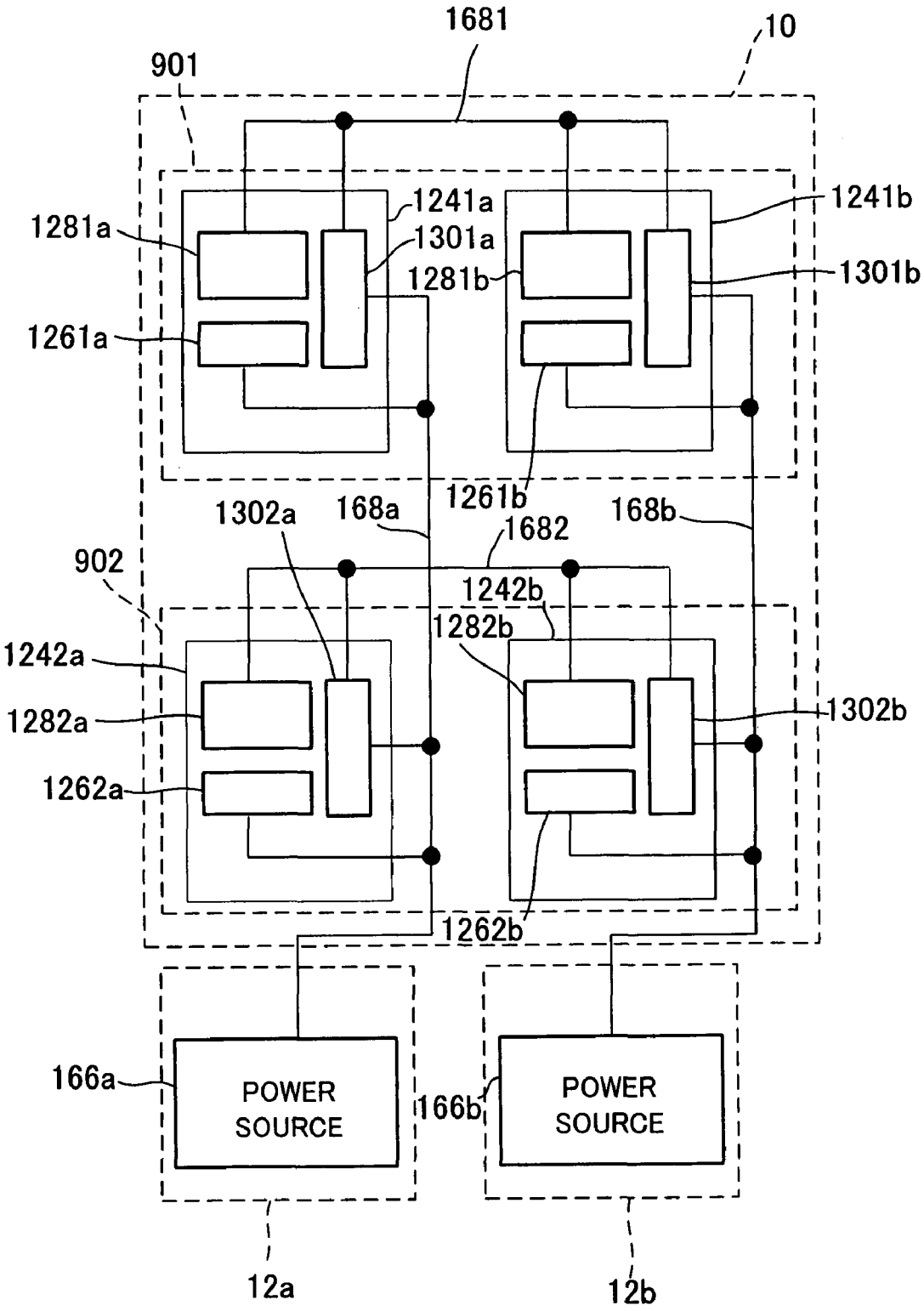
FIG. 6 is a view explaining supply of operating power to the lever position sensor units shown in FIG. 1.

FIG. 6 is a view explaining supply of operating power to the lever position sensor units 1241*a, b*, 1242*a, b*. In FIG. 6, merely the outboard motors, lever position sensor units and network power lines connecting them are illustrated for ease of understanding.

As shown in FIG. 6, a power source 166*a* of the port outboard motor 12*a* is connected to the main processing sections 1261*a*, 1262*a* and DC/DC converters 1301*a*, 1302*a* of the lever position sensor units 1241*a*, 1242*a* through a network power line 168*a*. Similarly, a power source 166*b* of the starboard outboard motor 12*b* is connected to the main processing sections 1261*b*, 1262*b* and DC/DC converters 1301*b*, 1302*b* of the lever position sensor units 1241*b*, 1242*b* through a network power line 168*b*.

In the first navigation unit 901, the isolation sections 1281*a, b* and DC/DC converters 1301*a, b* of the lever position sensor units 1241*a, b* are interconnected through a network power line 1681. In the second navigation unit 902, the isolation sections 1282*a, b* and DC/DC converters 1302*a, b* of the lever position sensor units 1242*a, b* are interconnected through a network power line 1682.

Specifically, the power source 166*a* of the port outboard motor 12*a* is directly connected to the main processing sections 1261*a*, 1262*a* of the lever position sensor units 1241*a*, 1242*a*, while being indirectly connected to the isolation sections 1281*a*, 1282*a* through the DC/DC converters 1301*a*, 1302*a*. The connections between the other power sources and the lever position sensor units have the same structures.

As a result, the operating power from the power source 166*a* of the port outboard motor 12*a* is directly supplied to the main processing sections 1261*a*, 1262*a* of the lever position sensor units 1241*a*, 1242*a* through the network power line 168*a*. The isolation section 1281*a* is supplied with the operating power through the DC/DC converter 1301*a* and network power line 1681, and isolation section 1282*a* is supplied with the operating power through the DC/DC converter 1302*a* and network power line 1682. The configuration of the power source 166*b* of the starboard outboard motor 12*b* to supply the operating power is the same as that of the port outboard motor 12*a*, so the explanation thereof is omitted.

The operation of the outboard motor control system thus configured will be explained taking the first navigation unit 901 and port outboard motor 12*a* as an example with reference to FIG. 1 and the like.

The lever position sensor unit 1241*a* determines a desired shift position based on the output of the lever position sensor 1221*a* (namely, the direction of manipulation of the shift/throttle lever 1201*a*) and sends an output or signal indicative of the desired shift position to the engine control unit 80*a* through the electric signal line 162*a*. The engine control unit 80*a* controls the operation of the shift motor 66*a* so that the output of the shift position sensor 74*a* becomes equal to the desired shift position.

When it is detected from the output of the shift position sensor 74*a* that the desired shift position has been established (shift position change has been completed), the lever position sensor unit 1241*a* determines desired throttle opening based on the output of the lever position sensor 1221*a* (namely, the amount of manipulation of the shift/throttle lever 1201*a*, i.e., lever position) and sends an output or signal indicative of the desired throttle opening to the engine control unit 80*a* through the electric signal line 162*a*. The engine control unit 80*a* controls the operation of the throttle motor 40*a* so that the output of the throttle opening sensor 72*a* becomes equal to the desired throttle opening.

As described, the outboard motor control system according to this embodiment is a DBW (Drive By Wire) control system without any mechanical connection between the navigation unit and the outboard motor. The operation of the lever position sensor unit 1241*b* and starboard outboard motor 12*b* is substantially the same as that of the lever position sensor unit 1241*a* and port outboard motor 12*a*, so the explanation thereof is omitted. Also, since the operation of the second navigation unit 902 is substantially the same as that of the first navigation unit 901, the explanation of the lever position sensor units 1242*a, b* of the second navigation unit 902 is omitted.

Figure 7:
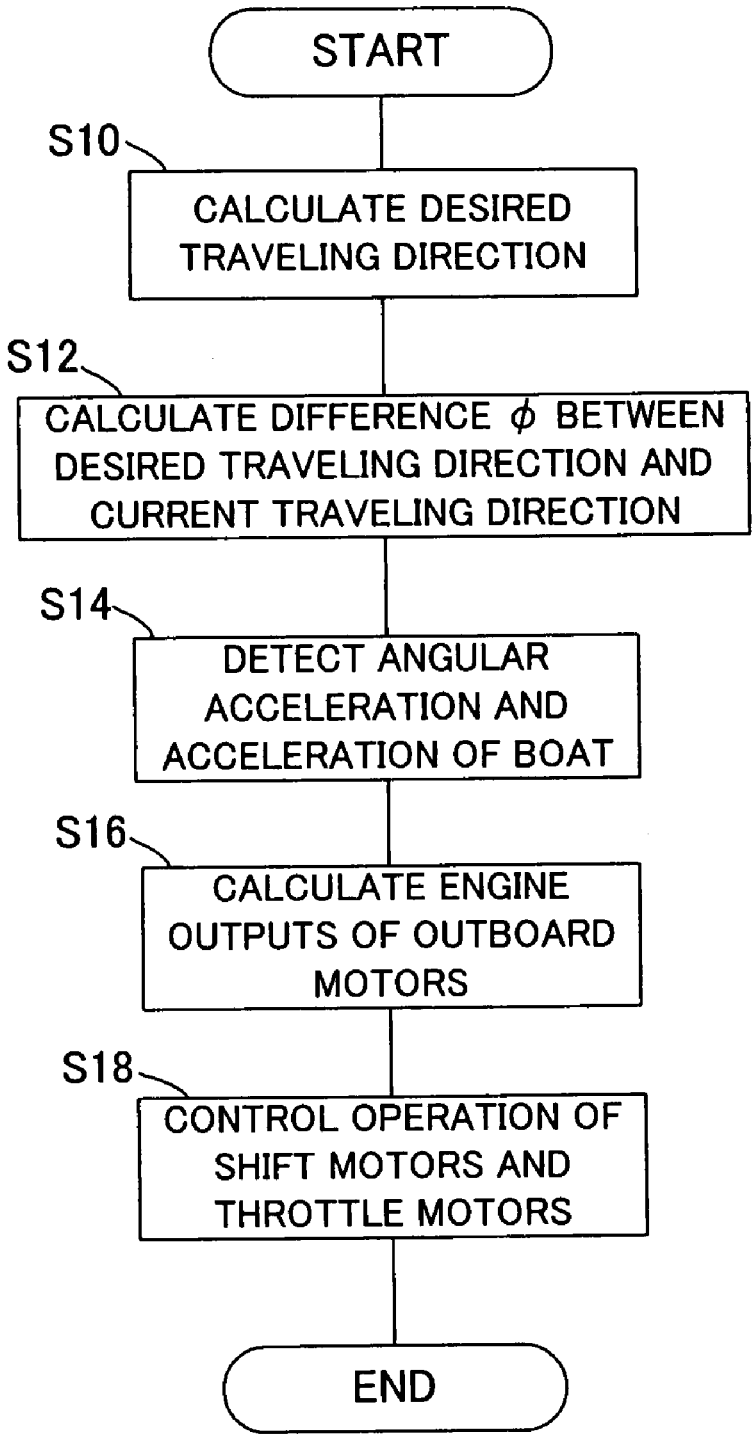
FIG. 7 is a flowchart showing the operation of the outboard motor control system, with focus on the processing of control of boat traveling direction.

Next, the operation of controlling a traveling direction of the boat, which is one of characteristic features of this invention, will be explained. FIG. 7 is a flowchart showing the operation of the outboard motor control system, with focus on the processing of control of a boat traveling direction. The illustrated program is executed in the engine control units 80*a, b* at a predetermined interval, e.g., 100 milliseconds.

First, in S10, the engine control units 80*a, b* detect steering angles of the steering wheels 921, 922 manipulated by the operator to calculate a steering command by the operator, i.e., a traveling direction of the boat desired by the operator (desired traveling direction). Specifically, the engine control units 80*a, b* are inputted with outputs of the steering angle sensors 981, 982 through the steering angle sensor units 1001, 1002 and lever position sensor units 1241*a, b*, 1242*a, b*, and based on the inputted values, calculate the desired traveling direction of the boat 10.

Figure 8:
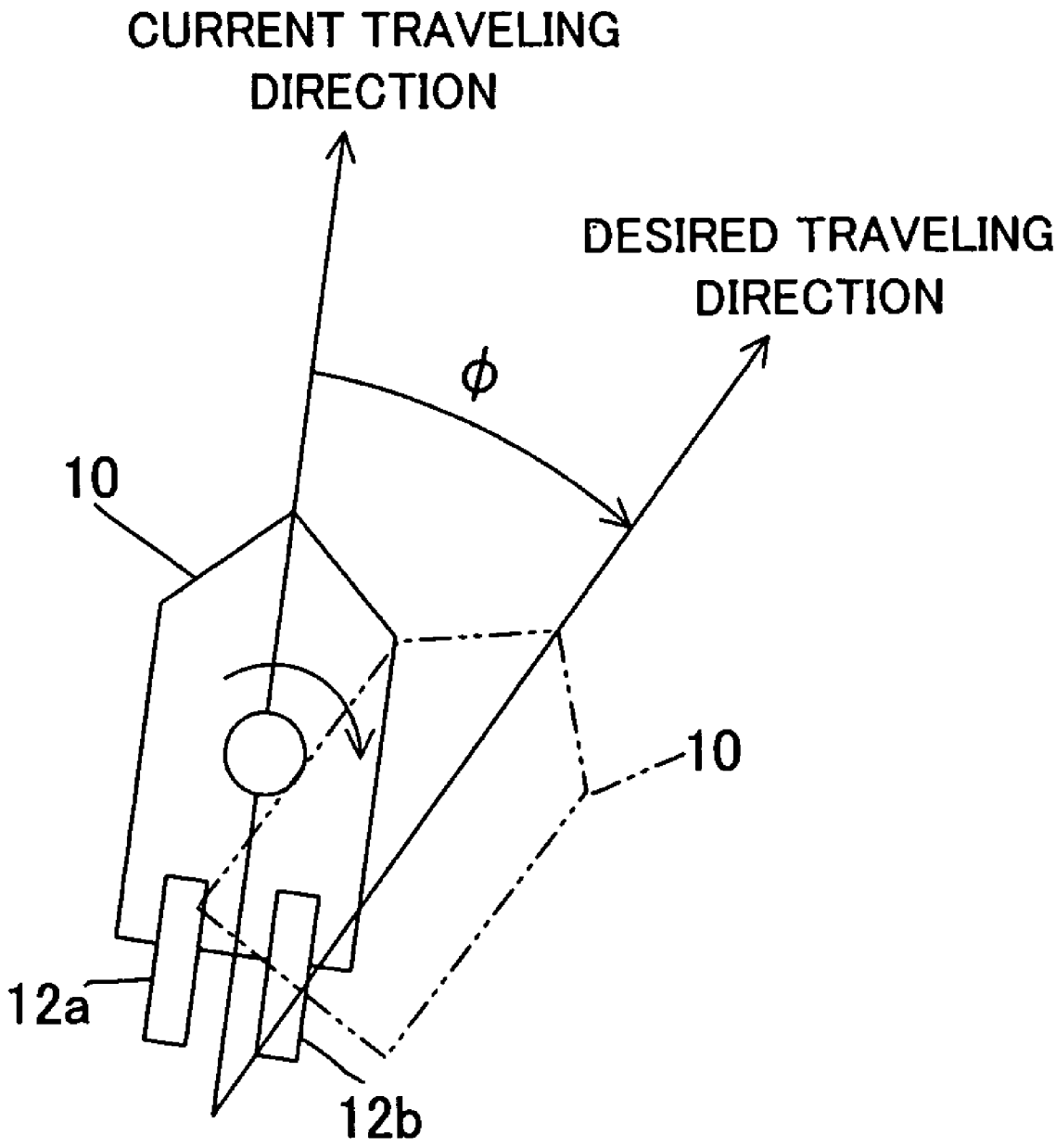
FIG. 8 is a view explaining a difference $\phi$ calculated in the flowchart of FIG. 7.

Next, in S12, a difference $\phi$ between the calculated desired traveling direction and current traveling direction of the boat is calculated. Specifically, the engine control units 80*a, b* are inputted with an output of the declinometer 82 (namely, the current traveling direction of the boat) through the lever position sensor units 1241*a, b*, 1242*a, b*, to calculate the difference $\phi$ between the inputted value and the desired traveling direction. FIG. 8 is a view explaining the difference $\phi$ calculated in S12. In FIG. 8, the boat facing in the desired traveling direction is illustrated by a dashed-two dotted line.

The program goes to S14, in which traveling speed of the boat 10 is detected, specifically, angular acceleration and acceleration of the boat 10 are detected from outputs of the angular acceleration sensor 84 and acceleration sensor 86, and to S16, in which based on the calculated difference ϕ and the detected angular acceleration and acceleration, outputs and the like of the engines 30*a, b* of the outboard motors 12*a, b* are calculated.

The program goes to S18, in which the operation of the shift motors 66*a, b* and throttle motors 40*a, b* is controlled to achieve the calculated engine outputs, i.e., such that the current traveling direction of the boat 10 becomes identical to the desired traveling direction, thereby regulating the traveling direction of the boat 10.

Figure 9:
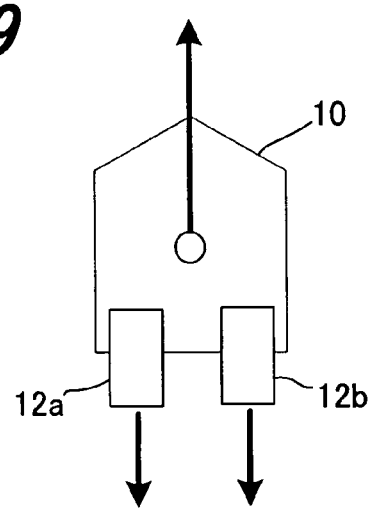
FIG. 9 is a view explaining the processing in the flowchart of FIG. 7.
Figure 10:
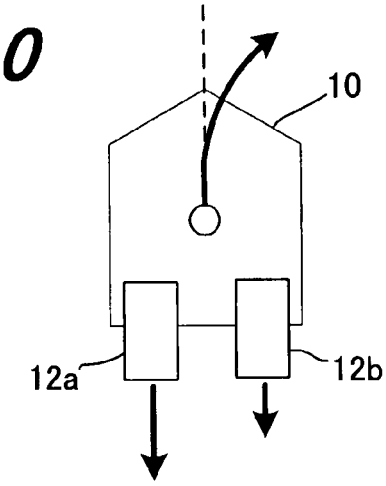
FIG. 10 is a view explaining the processing in the flowchart of FIG. 7, similarly to FIG. 9.
Figure 11:
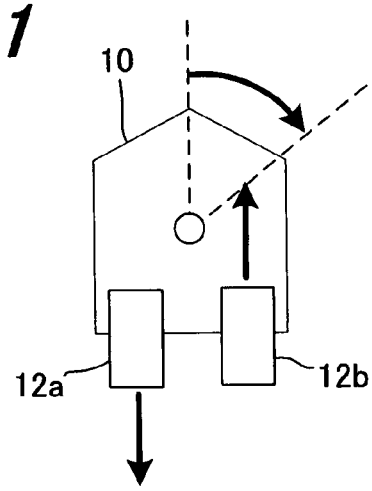
FIG. 11 is a view explaining the processing in the flowchart of FIG. 7, similarly to FIG. 9.

The processing of S16 and S18 will be explained in detail with reference to FIGS. 9 to 11. When the operator does not manipulate the steering wheels 921, 922, i.e., desires to move the boat 12 straight ahead, the engine control units 80*a, b* control the operation of the throttle motors 40*a, b* cooperatively to make the outputs of the port and starboard outboard motors 12*a, b* identical, as shown in FIG. 9. In FIGS. 9 to 11, arrows extending from the outboard motors indicate the outputs of the outboard motors (engine output), and length thereof indicates magnitude of the outputs.

When the operator manipulates the steering wheels 921, 922 clockwise, i.e., desires to move the boat 10 in the rightward direction, the difference ϕ is generated between the desired traveling direction and current traveling direction. Based on the difference ϕ, angular acceleration and acceleration, the engine control units 80*a, b* cooperatively control the operation of the throttle motor 40*b* of the outboard motor installed on a side facing the desired traveling direction (right side in this case), i.e., the starboard outboard motor 12*b*. In other words, as shown in FIG. 10, the throttle motor 40*b* of the starboard outboard motor 12*b* is operated so that the throttle valve 38*b* is driven in the closing direction to decrease the engine speed (engine output), thereby regulating the boat 10 to travel to the right.

On the other hand, although not shown in the drawing, when the operator manipulates the steering wheels 921, 922 counterclockwise, i.e., desires to move the boat 10 in the leftward direction, the engine control units 80*a, b* control the operation of the throttle motor 40*a* of the port outboard motor 12*a* based on the difference ϕ, angular acceleration and acceleration. Specifically, the throttle motor 40*a* of the port outboard motor 12*a* is operated so that the throttle valve 38*a* is driven in the closing direction to decrease the engine speed (engine output), thereby regulating the boat 10 to travel to the left.

In the case where the operator manipulates the steering wheels 921, 922 clockwise with the boat 10 being stopped, i.e., desires to turn the boat clockwise at that position, similarly the difference ϕ is generated between the desired traveling direction and current traveling or facing direction. As shown in FIG. 11, based on the difference ϕ, angular acceleration and acceleration, the engine control units 80*a, b* control the operation of the shift motors 66*a, b* and throttle motors 40*a, b* so that the port outboard motor 12*a* produces thrust in the forward direction and the starboard outboard motor 12*b* produces thrust in the rearward direction. As a result, the boat 10 is turned clockwise at the same position.

On the other hand, although not shown in the drawing, when the operator manipulates the steering wheels 921, 922 counterclockwise with the boat 10 being stopped, the engine control units 80*a, b* control the operation of the shift motors 66*a, b* and throttle motors 40*a, b* based on the difference ϕ, angular acceleration and acceleration so that the port outboard motor 12*a* produces thrust in the rearward direction and the starboard outboard motor 12*b* produces thrust in the forward direction. As a result, the boat 10 is turned counterclockwise at the same position.

As stated above, the embodiment is configured to have a system for controlling a plurality of, i.e., two outboard motors 12*a, b* each adapted to be mounted on a stern of a boat 10 and each having an internal combustion engine 30 and a shift mechanism 44, an actuator (electric shift motor 66*a, b*, electric throttle motor 40*a, b*) adapted to drive at least one of the shift mechanism and a throttle valve 38 of the engine, and a controller (engine control unit 80*a, b*) adapted to control operation of the actuator, comprising: a navigation unit 901, 902 having a steering wheel 921, 922 installed to be freely operable by an operator and a steering angle detector (steering angle sensor 981, 982, steering angle sensor unit 1001, 1002) adapted to produce an output indicative of a steering angle of the steering wheel, wherein the outboard motors are immovably fastened to the boat, such that each of the controllers controls the operation of the actuator cooperatively based on the output of the steering angle detector, to regulate traveling direction of the boat.

Specifically, it is configured such that the outboard motors 12*a, b* each using the actuator to drive the shift mechanism 44 and throttle valve 38, i.e., the outboard motors 12*a, b* that do not include a steering mechanism and an actuator for driving the steering mechanism, are immovably fastened to the boat 10, and configured to control the operation of the actuators to regulate the traveling direction of the boat 10 based on the detected steering angle. Owing to this configuration, the outboard motor can be compact by portion of a steering mechanism and actuator for driving the steering mechanism, thereby enabling to improve cost performance. Further, since it is configured such that, based on the detected steering angle, i.e., steering command issued by the operator, the shift mechanism 44 and throttle valve 38 are operated to control the engine output (e.g., control the outboard motors 12*a, b* to produce different outputs), it becomes possible to control the traveling direction of the boat 10 in accordance with the issued steering command.

The system according to the embodiment further includes a declinometer 82 adapted to produce an output indicative of a traveling direction of the boat; and a traveling speed detector (angular acceleration sensor 84, acceleration sensor 86) adapted to produce an output indicative of a traveling speed of the boat 10, and each of the controllers inputs the outputs of the declinometer and the traveling speed detector and controls the operation of the actuator based on the outputs.

In the system according to the embodiment, the traveling speed detector includes an angular acceleration sensor 84 and an acceleration sensor 86.

In the system according to the embodiment, the navigation unit includes: a shift/throttle lever 1201*a, b*, 1202*a, b* installed to be freely operable by the operator; and a lever position detector (lever position sensor 1221*a, b*, 1222*a, b*, lever position sensor unit 1241*a, b*, 1242*a, b*) adapted to produce an output indicative of a manipulated position of the shift/throttle lever, wherein the steering angle detector is connected to the lever position detector through a first signal line (electric signal line 1621, 1622), and the lever position detector is connected to each of the controllers through a second signal line (electric signal line 162*a*, 162*b*).

In the system according to the embodiment, the number of the outboard motors is two.

Further it is configured to have a system for controlling a plurality of, i.e., two outboard motors 12*a, b* each adapted to be mounted on a stem of a boat 10 and each having an internal combustion engine 30 and a shift mechanism 44, a plurality of actuators (electric shift motor 66*a, b*, electric throttle motor 40*a, b*) each adapted to drive the shift mechanism and a throttle valve 38 of the engine, and a controller (engine control unit 80*a, b*) adapted to control operation of the actuators, comprising: a navigation unit 901, 902 having a steering wheel 921, 922 installed to be freely operable by an operator and a steering angle detector (steering angle sensor 981, 982, steering angle sensor unit 1001, 1002) adapted to produce an output indicative of a steering angle of the steering wheel, wherein the outboard motors are immovably fastened to the boat, such that each of the controllers controls the operation of the actuator cooperatively based on the output of the steering angle detector, to regulate traveling direction of the boat.

The system according to the embodiment further includes: a declinometer 82 adapted to produce an output indicative of a traveling direction of the boat; and a traveling speed detector (angular acceleration sensor 84, acceleration sensor 86) adapted to produce an output indicative of a traveling speed of the boat, and each of the controllers inputs the outputs of the declinometer and the traveling speed detector and controls operation of the actuator based on the outputs.

In the system according to the embodiment, the navigation unit includes: a shift/throttle lever 1201*a, b*, 1202*a, b* installed to be freely operable by the operator; and a lever position detector (lever position sensor 1221*a, b*, 1222*a, b*, lever position sensor unit 1241*a, b*, 1242*a, b*) adapted to produce an output indicative of a manipulated position of the shift/throttle lever, wherein the steering angle detector is connected to the lever position detector through a first signal line (electric signal line 1621, 1622), and the lever position detector is connected to each of the controller through a second signal line (electric signal line 162*a*, 162*b*).

In the system according to the embodiment, the numbers of the outboard motors and the actuators are two each.

It should be noted that although, in the foregoing, two outboard motors are mounted or fixed on the boat 10, the invention can also be applied to multiple outboard motor installations comprising three or more outboard motors.

It should further be noted that the number of the steering wheel can be one or three, or more, instead of two. The point is that, as far as the configuration enables the operator to input a steering command, the number thereof is not a problem. In that sense, the description of "a steering wheel" is used in Claims. Also, although the number of the shift/throttle lever is configured to be the same as that of the outboard motor, it can be one or three, or more.

It should further be noted that, although the displacement of the engine 30 and the like are indicated with specific values in the foregoing, they are only examples and not limited thereto.

Japanese Patent Application No. 2006-313464 filed on Nov. 20, 2006, is incorporated herein in its entirety.

While the invention has thus been shown and described with reference to a number of specific embodiments, it should be noted that the invention is in no way limited to the details of the described arrangements; changes and modifications may be made without departing from the scope of the appended claims.

What is claimed is:

1. In combination a plurality of non-steerable outboard motors each adapted to be mounted on a stern of a boat and an engine control system for controlling the outboard motors when the outboard motors are mounted to the boat, each of said outboard motors comprising:

an internal combustion engine, a shift mechanism, an actuator adapted to drive at least one of the shift mechanism and a throttle valve of the engine, and a controller adapted to control operation of the actuator, the engine control system comprising:

a navigation unit having a steering wheel installed to be freely operable by an operator and a steering angle detector adapted to produce an output indicative of a steering angle of the steering wheel, wherein the outboard motors are configured to be fastened to the boat in a manner such that the motors cannot be rotated laterally relative to the boat for all steering operations of the motors, and wherein the control system is configured such that each of the controllers of the outboard motors respectively control the operation of the actuator of the corresponding outboard motor cooperatively based on the output of the steering angle detector, to regulate a traveling direction of the boat.

2. The combination according to claim 1, further including:

a declinometer adapted to produce an output indicative of a traveling direction of the boat; and a traveling speed detector adapted to produce an output indicative of a traveling speed of the boat, and each of the controllers inputs the outputs of the declinometer and the traveling speed detector and controls the operation of the actuator based on the outputs.

3. The combination according to claim 2, wherein the traveling speed detector includes an angular acceleration sensor and an acceleration sensor.

4. The combination according to claim 1, wherein the navigation unit further includes:

a shift/throttle lever installed to be freely operable by the operator; and a lever position detector adapted to produce an output indicative of a manipulated position of the shift/throttle lever, wherein the steering angle detector is connected to the lever position detector through a first signal line, and the lever position detector is connected to each of the controllers through a second signal line.

5. The combination according to claim 1, wherein the number of the outboard motors is two.

6. The combination according to claim 1, wherein the actuator is an electric motor.

7. The combination according to claim 1, wherein the engine control system is a drive-by wire system, and each of the outboard motors does not include a steering mechanism or a steering actuator connected thereto such that the motors cannot be rotated laterally relative to the boat for all steering operations of the motors.

8. The combination according to claim 1, comprising a second navigation unit, each navigation unit being respectively associated with said outboard motors, wherein the second navigation unit includes:

a steering wheel installed to be freely operable by an operator and a steering angle detector associated with said steering wheel and adapted to produce an output indicative of the steering angle of the steering wheel;

wherein each of the navigation units includes:

a shift/throttle lever installed to be freely operable by the operator; and a lever position detector associated with said shift/throttle lever and adapted to produce an output indicative of a manipulated position of the shift/throttle lever, wherein the steering angle detector of each of the navigation units is connected to the lever position detector of the associated one of the navigation units through a first signal line, and the lever position detector of each of the navigation units is connected to the controller of a respective one of the outboard motors through a second signal line.

9. The combination according to claim 1, wherein the steering angle detector output is directly sent to the controllers through respective signal lines.

10. The combination according to claim 1, wherein the control system and the controllers of the outboard motors are configured to collectively steer the boat exclusively through cooperative control of the shift mechanisms and the throttle valves of the engines via the actuators of the respective outboard motors in all steering operations of the motors.

11. The combination according to claim 4, wherein the outputs sent by the steering angle detector and the lever position detector to each of the controllers of the outboard motors through the respective signal lines do not include any identification of the outboard motors.

12. In combination a plurality of non-steerable outboard motors each adapted to be mounted on a stern of a boat and an engine control system for controlling the outboard motors when the outboard motors are mounted to the boat, each of said outboard motors comprising:

an internal combustion engine, a shift mechanism, a plurality of actuators respectively adapted to drive the shift mechanism and a throttle valve of the engine, and a controller adapted to control operation of the actuators, the engine control system comprising:

a navigation unit having a steering wheel installed to be freely operable by an operator and a steering angle detector adapted to produce an output indicative of a steering angle of the steering wheel, wherein the outboard motors are configured to be fastened to the boat in a manner such that the motors cannot be rotated laterally relative to the boat for all steering operations of the motors, and wherein the control system is configured such that each of the controllers of the outboard motors respectively control the operation of the actuators of the corresponding outboard motor cooperatively based on the output of the steering angle detector, to regulate traveling direction of the boat.

13. The combination according to claim 12, further including:

a declinometer adapted to produce an output indicative of a traveling direction of the boat; and a traveling speed detector adapted to produce an output indicative of a traveling speed of the boat, and each of the controllers inputs the outputs of the declinometer and the traveling speed detector and controls operation of the corresponding actuators based on the outputs.

14. The combination according to claim 12, wherein the navigation unit further includes:

a shift/throttle lever installed to be freely operable by the operator; and a lever position detector adapted to produce an output indicative of a manipulated position of the shift/throttle lever, wherein the steering angle detector is connected to the lever position detector through a first signal line, and the lever position detector is connected to each of the controller through a second signal line.

15. The combination according to claim 12, wherein the number of the outboard motors is two and the number of actuators of each motor is two.

16. The combination according to claim 12, wherein the engine control system is a drive-by wire system, and each of the outboard motors does not include a steering mechanism or a steering actuator connected thereto such that the motors cannot be rotated laterally relative to the boat for all steering operations of the motors.

17. The combination according to claim 12, comprising a second navigation unit, each navigation unit being respectively associated with said outboard motors, wherein the second navigation unit has a steering wheel installed to be freely operable by an operator and a steering angle detector associated with said steering wheel and adapted to produce an output indicative of the steering angle of the steering wheel, wherein each of the navigation units includes:

a shift/throttle lever installed to be freely operable by the operator; and a lever position detector associated with said shift/throttle lever and adapted to produce an output indicative of a manipulated position of the shift/throttle lever, wherein the steering angle detector of each of the navigation units is connected to lever position detector of the associated one of the navigation units through a first signal line, and the lever position detector of each of the navigation units is connected to the controller of a respective one of the outboard motors through a second signal line.

18. The combination according to claim 12, wherein the steering angle detector output is directly sent to the controllers through respective signal lines.

19. The combination according to claim 12, wherein the control system and the controllers of the outboard motors are configured to collectively steer the boat exclusively through cooperative control of the shift mechanisms and the throttle valves of the engines via the actuators of the respective outboard motors in all steering operations of the motors.

20. The combination according to claim 14, wherein the outputs sent by the steering angle detector and the lever position detector to each of the controllers of the outboard motors through the respective signal lines do not include any identification of the outboard motors.

* * * * *